United States Patent [19]

Donhauser

[11] 4,371,995

[45] Feb. 8, 1983

[54] RECREATIONAL BASIN

[76] Inventor: William H. Donhauser, 1128 Amador Ave., Berkeley, Calif. 94707

[21] Appl. No.: 241,479

[22] Filed: Mar. 9, 1981

[51] Int. Cl.[3] ..... A47K 3/02

[52] U.S. Cl. ..... 4/538; 4/541; 4/546; 4/553; 4/584

[58] Field of Search ..... 4/544, 543, 542, 541, 4/592, 545, 553, 539, 559, 571, 584, 538, 546; 128/66, 369

[56] References Cited

U.S. PATENT DOCUMENTS

| | | | |
|---|---|---|---|
| 743,025 | 11/1903 | Von Orth | 4/542 X |
| 3,248,741 | 5/1966 | Stout et al. | 4/539 |
| 3,346,884 | 10/1967 | Roy | 4/592 |
| 3,911,505 | 10/1975 | Zaborowsky | 4/545 |
| 3,969,776 | 7/1976 | Gildea | 4/546 |
| 4,197,838 | 4/1980 | Shill | 4/542 X |
| 4,233,694 | 11/1980 | Janosko et al. | 4/544 |

*Primary Examiner*—Henry K. Artis

*Attorney, Agent, or Firm*—Bielen and Peterson

[57] ABSTRACT

A recreational basin having a tub with an inlet for fluids thereto. A pan is superposed in relation to the tub such that fluids can drain from the pan into the tub. A pump transfers fluid from the tub to the pan while a screening device prevents solids from moving from the pan to the tub. A regulator maintains a desired level of fluid in the tub.

9 Claims, 3 Drawing Figures

FIG-1
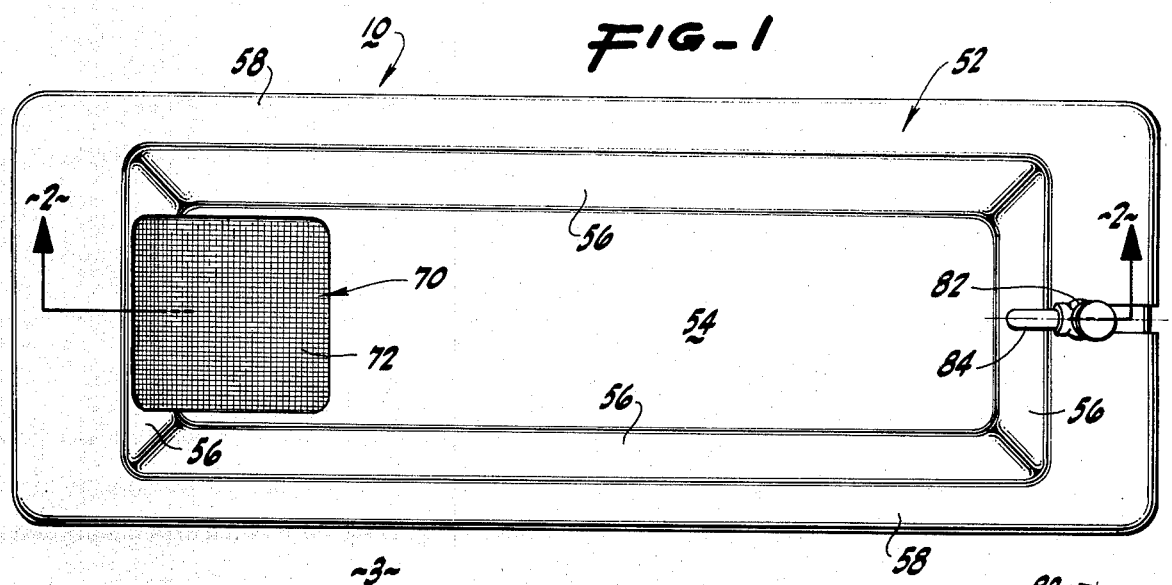
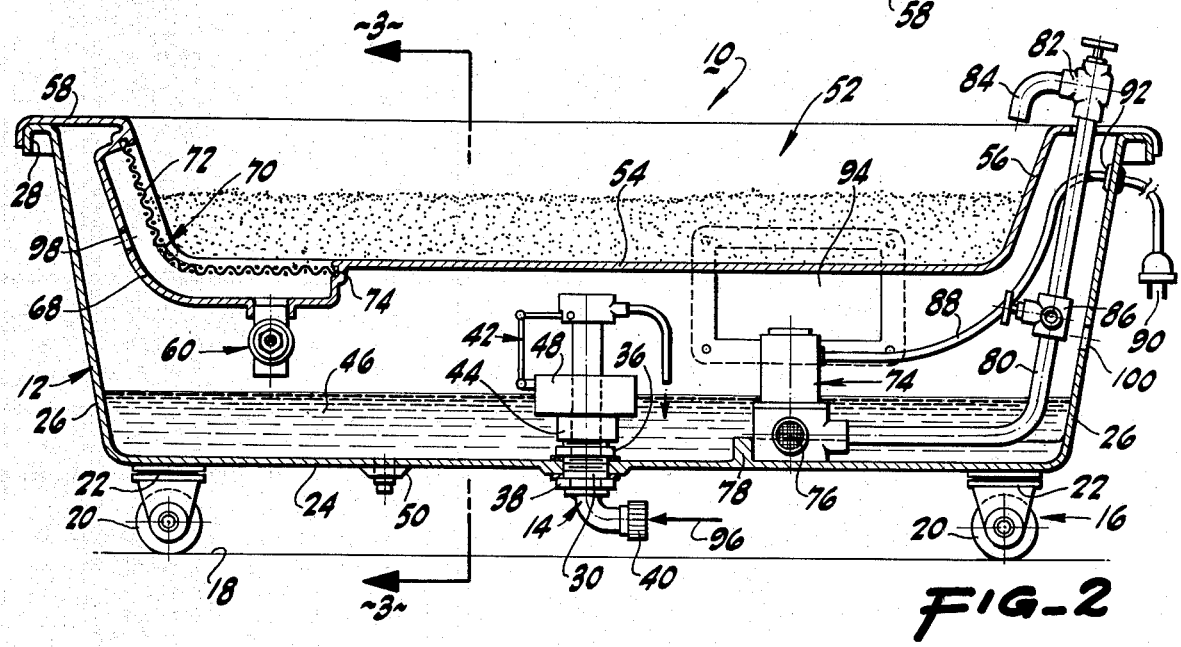
FIG-2
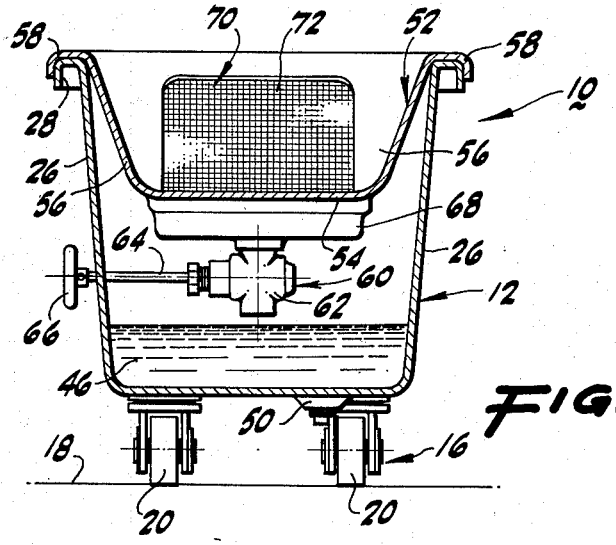
FIG-3

RECREATIONAL BASIN

BACKGROUND OF THE INVENTION

The present invention relates to a novel recreation basin which may be used with solids such as sand and fluids which are recirculated.

It has been found that children derive great pleasure in play areas such as sand boxes or wading pools. U.S. Pat. No. 2,199,915 describes a child's play bowl which shows a bowl having an umbrella support thereabove. U.S. Pat. No. 2,628,364 describes a collapsible play pool which has a water inlet to the same. U.S. Pat. No. 2,848,229 and U.S. Pat. No. 3,339,213, teach sand boxes which may be used in combination or alternatively, as other play environments. U.S. Pat. No. 2,073,784 shows a swimming pool circulation apparatus which uses localized circulation techniques.

None of the prior art describes a device or apparatus which may combine the use of solids and fluids as a play pen or play area for a child.

A device which could be used in the above described situation would be most desirable.

SUMMARY OF THE INVENTION

In accordance with the present invention a novel and useful recreational basin holding solids and fluid is provided.

The recreational basin of the present invention includes a tub which has a fluid inlet. The tub may be transportable and include means for providing the same. Such means may take the form of castors, rollers, slides, or the like, fixed to the bottom portion of the tub. A pan may be superposed in relation to the tub and include means for draining fluid from the pan to the tub. The pan may take the form of an inset which includes side or end portions overlapping the periphery of the upper portion of the tub. Means for screening solids from the fluid draining from the pan to the tub may be included in the pan. Such screening means may take the form of a sump located in a portion of the pan and extending from the bottom of the pan to the upright side portions thereof. The sump may include a drain hole leading to the tub as well as means for supporting a screen above the sump.

The recreational basin may also have means for pumping fluid from the tub to the pan to complete the recirculation of the fluids. Such pumping means may take the form of a submersible pump placed in the tub beneath the pan. Such submersible pump may be electrically motivated and include a relief valve which would prevent loss of fluids if the path between the pump and the pan where blocked. Any solids entering the tub would be prevented from entering the inlet to the pump by the use of dam or barrier surrounding at least a portion of the pump for that purpose.

Means is also provided for regulating the level of fluid in the tub. Such regulating means may take the form of a float valve and may include means for predetermining the level of fluid in the tub.

Thus, a portable recreational basin which may be used as a wet sand box has been described and is useful and novel in light of the known prior art.

It is therefore an object of the present invention to provide a recreational basin which may be used to create dramatic environmental scenes or miniature landscapes including the use of solids and fluids.

It is yet another object of the present invention to provide a recreational basin which may be employed as a terrarium or vivarium and may employ hydroponic medium for maintaining plant life.

It is another object of the present invention to provide a recreational basin which may be employed to study erosion and flow systems modeled on existing geological formations.

It is yet another object of the present invention to provide a recreational basin useable by adults or children in the form of an ornamental garden.

It is yet another object of the present invention to provide a recreational basin which is capable of recirculating fluids which are initially mixed with solids, separated therefrom, and recombined with the same.

The invention possesses other objects and advantages especially as concerns particular characteristics and features thereof which will become apparent as the specification continues.

BRIEF DESCRIPTION OF THE DRAWINGS

FIG. 1 is a top plan view of the present invention.

FIG. 2 is a sectional view taken along line 2—2 of FIG. 1.

FIG. 3 is a sectional view taken along line 3—3 of FIG. 2.

For a better understanding of the invention reference is made to the following detailed description which should be referenced to the hereinabove described drawings.

DESCRIPTION OF THE PREFERRED EMBODIMENTS

Various aspects of the present invention will evolve from the following detailed description of the preferred embodiments thereof which should be taken in conjuction with the hereinabove descritbed drawings.

The invention as a whole is represented in the drawings by reference character 10. The recreational basin 10 includes a tub 12 having a fluid inlet 14 thereto. Tub 12 may be constructed of porcelain, metal, plastic, or like materials. Means 16 is provided to transport tub 12 along ground surface 18. Means 16 may take the form of a plurality of casters 20, FIGS. 2 and 3, which are attached to tub 12 via plurality of swivels 22. Tub 12 includes a bottom portion 24, side portions 26, and lip 28 which extends around the periphery thereof.

Inlet 14 includes a fitting 30 which seals a pair of gaskets between threaded nuts 36 and 38. Coupling 40 may be adapted to engaging the male end of a common garden hose. A float valve 42, such as the Model 400A float valve manufactured by Fluid Master of Anaheim, Calif., is shown and may include means 44 for determining the level of fluid 46 within tub 12. Means 44 may take the form of a spacer beneath float 48 of float valve 44. Tub 12 also includes a drain 50 located at bottom 24 thereof.

A pan 52 is placed over tub 12. Pan 52 includes a bottom portion 54 and generally upright side portions 56. As shown in FIGS. 2 and 3, side portions 56 terminate in a platform 58 which hooks over lip 28 of tub 12. Pan 52 may be constructed of plastic, metal, and the like. Pan 52 possesses means 60 for draining fluid from pan 52 to tub 12. As shown on FIG. 3, draining means 60 includes a valve 62 having a valve stem 64 and a handle portion 66 which extends through the side portion of tub 12. Thus, valve 62 may be easily operated on the outside of basin 10. Means 60 is located in a sump 68 located at one end of pan 52. Sump 68 extends from the bottom 54 to the side portions 56 of pan 52. Means 70 for screening solids from the fluid draining from pan 52 to pan 12 is located in pan 52 above sump 68. Means 70 includes a screen 72 held in a recess 74, FIG. 2, which surrounds the upper portion of sump 68. It should be noted that a portion of screen 72 extends along side portions 56 of pan 52 which allows gravitational forces to clear the solids from screen 72 during the operation of basin 10.

Means 74 is also provided for pumping fluid from tub 12 to pan 52. Means 74 may be an electrically operated submersible pump such as the Model 875 SF Pump manufactured by Calvert Engineering of Van Nuys, Calif. Pump 74 includes an inlet 76 and means 78 for preventing fine solids from entering inlet 76. Means 78 may take the form of a barrier formed or attached to bottom 24 of tub 12. The outlet of pumping means 74 includes a pipe 80 which directs fluids to pan 52 via valve 82 and spigot 84. Relief valve 86 insures the return of fluids to tub 12 if valve 82 is closed. Electrical cord 88 and male plug 90 pass through wall portion 26 of tub 12 by the use of water tight fitting 92, FIG. 2. An access door 94 is included such that one may easily reach the components of recreational basin 10 found in tub 12 below pan 52. Overflow vents 98 and 100 permit excess fluid from sump 68 to tub 12 and from tub 12 to ground surface 18 respectively.

In operation, sand or other solids are placed in pan 52 having a fineness which would prevent most of the same from passing through screen 72. For example, screen 72 may be constructed of brass having thirty two wires per inch. Water is then sent through inlet 14, as shown by directional arrow 96, to fill tub 12 to the level shown in FIGS. 2 and 3. Means 44 would regulate the level in tub 12 as desired. Submersible pump 74 is then activated via electrical cord 88 such that fluid 46 is pumped through pipe 80 and enters pan 52 through valve and spigot 82 and 84. Valve 62 may be used to permit to drain from pan 52 through screen means 70 and sump 68, into tub 12. Also, valve 62 may be used to regulate the rate of flow of fluid from pan 52 to tub 12. The flow of fluid from tub 12 to pan 52 may be regulated or stopped by valve 82. Relief valve 86 would insure recirculation of fluid 46 to tub 12 if valve 82 were to remain open. Of course, removing the electrical power to pump 74 would interrupt the pumping of fluid from tub 12 to pan 52. Recreational basin 10 may be moved to different locations via means 16. Also, a cover may be placed over recreational basin 10 (not shown) to protect the same from the elements. For example, poles may be placed in platform 58 to accept posts for a greenhouse type top. As heretofore described, recreational basin 10 may serve many purposes, not the least of which would be to place a terrarium of garden in pan 52. In such a case, a timing device (not shown) may be used to regulate the flow of fluid from pump means 74 to satisfy the watering needs of any plants contained in such a garden or terrarium. It is anticipated that tub 12 would be sized to accommodate the minimum amount of fluid 46 necessary to operate pumping means 74 as well as the volume of water in pan 52 determined by the height of vent 98 above bottom 54. In this manner, overflow vent 100 would only pass water if float valve 42 malfunctioned.

While in the foregoing specification embodiments of the invention have been set forth in considerable detail for the purposes of making a complete disclosure of the invention, it should be apparent to those of ordinary skill in the art that numerous changes may be made in such details without departing from the spirit and principles of the invention.

What is claimed is:

1. A recreational basin holding solids and fluid comprising:

a. a tub having a fluid inlet thereto;

b. a pan superposed in relation to said tub, said pan including means for draining fluid therefrom to said tub;

c. means for pumping fluids from said tub to said pan, said pumping means having a fluid inlet in said tub;

d. means for screening solids from the fluid draining from said pan to said tub;

e. means for regulating the level of fluid in said tub.

2. The recreational basin of claim 1 which additionally comprises means for preventing solids from entering said fluid inlet of said pumping means.

3. The recreational basin of claim 2 in which said means for screening solids from the fluid draining means includes a sump located in a portion of said pan, said sump including a drain hole leading to said tub, said sump further including means for supporting a screen over said sump.

4. The recreational basin of claim 3 in which said sump extends from the bottom of said pan to the upright side portions thereof.

5. The recreational basin of claim 4 in which said means for draining fluid from said pan includes a valve placed in said sump drain hole leading to said tub.

6. The recreational basin of claim 5 in which said pumping means comprises a submersible pump.

7. The recreational basin of claim 6 which additionally comprises means for transporting said tub.

8. The recreational basin of claim 3 in which said means for supporting a screen over said sump includes a recess in said pan substantially surrounding said sump, said recess being sized to hold said screen.

9. The recreational basin of claim 7 in which said means for regulating the level of fluid in said tub includes means for predetermining the level of fluid in said tub.

* * * * *